US005127466A

United States Patent [19]

Ando

[11] Patent Number: 5,127,466

[45] Date of Patent: Jul. 7, 1992

[54] HEAT EXCHANGER WITH HEADER BRACKET AND INSERTABLE HEADER PLATE

[75] Inventor: Nobuyasu Ando, Takasaki, Japan

[73] Assignee: Sanden Corporation, Isesaki, Japan

[21] Appl. No.: 593,060

[22] Filed: Oct. 5, 1990

[30] Foreign Application Priority Data

Oct. 6, 1989 [JP] Japan ..... 1-117797[U]
Oct. 6, 1989 [JP] Japan ..... 1-117798[U]

[51] Int. Cl.[5] ..... F28F 9/02; F28D 1/053

[52] U.S. Cl. ..... 165/67; 165/153; 165/173; 29/890.052

[58] Field of Search ..... 29/890.052; 165/173, 165/153, 67

[56] References Cited

U.S. PATENT DOCUMENTS

| | | | |
|---|---|---|---|
| 3,238,606 | 3/1966 | Tolson | 29/890.052 |
| 3,307,622 | 3/1967 | Oddy | 165/175 |
| 3,310,868 | 3/1967 | La Porte et al. | 29/890.054 |
| 3,689,972 | 9/1972 | Mosier et al. | 29/890.046 |
| 3,993,126 | 11/1976 | Taylor | 165/173 |
| 4,265,225 | 5/1981 | Berger et al. | 165/173 |
| 4,529,034 | 7/1985 | Saperstein | 165/134 |
| 4,569,390 | 2/1986 | Knowlton et al. | 165/149 |
| 4,615,385 | 10/1986 | Saperstein et al. | 165/175 |
| 4,651,816 | 3/1987 | Struss et al. | 165/76 |
| 4,678,026 | 7/1987 | Lenz et al. | 165/67 |
| 4,738,308 | 4/1988 | Moranne | 165/173 |
| 4,825,941 | 5/1989 | Hoshino et al. | 165/153 |
| 4,938,284 | 7/1990 | Howells | 165/153 |

FOREIGN PATENT DOCUMENTS

| | | | |
|---|---|---|---|
| 631222 | 11/1961 | Canada | 29/890.054 |
| 63-112065 | 5/1988 | Japan . | |
| 699032 | 10/1953 | United Kingdom | 165/173 |

*Primary Examiner*—Martin P. Schwadron
*Assistant Examiner*—L. R. Leo
*Attorney, Agent, or Firm*—Banner, Birch, McKie & Beckett

[57] ABSTRACT

A heat exchanger includes a pair of header pipes and tubes disposed between the header pipes. Each tube is connected to the header pipes at its end portions. Each of the header pipes comprises a tubular member and a connecting plate. The tubular member defines an opening which is formed at a position in the circumferential direction of the tubular member and extends in the longitudinal direction of the tubular member. The connecting plate is installed in the defined opening of the tubular member and has a plurality of holes for inserting the end portions of the tubes therein to connect the tubes to each header pipe. The connecting plate is formed as a simple shape, and the plurality of holes are easily and precisely processed. Therefore, the tubes can be easily and efficiently connected to the header pipes and the header pipes can be inexpensively manufactured. Since a bracket for supporting the heat exchanger can be attached to a flat portion formed on the tubular member by fastening, the working efficiency can also be increased.

14 Claims, 3 Drawing Sheets

HEAT EXCHANGER WITH HEADER BRACKET AND INSERTABLE HEADER PLATE

BACKGROUND OF THE INVENTION

1. Field of the Invention

The present invention relates to a heat exchanger for use as a condenser and a radiator of an air conditioner for a vehicle etc.

2. Description of the Prior Art

FIGS. 6 and 7 show a typical conventional heat exchanger which requires the heat exchange between a heat medium (for example, a cooling medium or a brine) flowing in the heat exchanger and air passing through the heat exchanger. A heat exchanger 21, as shown in FIG. 6, is comprised of a pair of header pipes 22 extending in parallel relation to each other, a plurality of tubes 23 disposed between the header pipes and connected to the header pipes at their end portions, a plurality of radiation fins 24 provided on the sides of the tubes, a pair of reinforcement members 25 disposed on the top and bottom radiation fins, and brackets 26 for supporting the heat exchanger which are attached to the upper and lower portions of each header pipe.

Each header pipe 22 is constructed from a straight pipe having a circular cross section. A plurality of connection holes 27 are formed on the periphery of the header pipe with a predetermined pitch in the axial direction of the header pipe.

The end portion of each tube 23 is inserted into a corresponding connection hole 27. Both ends of each header pipe 22 are closed by caps 28. An inlet tube 29 for introducing the heat medium into heat exchanger 21 is connected to one of the header pipes 22, and an outlet tube 30 for delivering the heat medium out from heat exchanger 21 is connected to the other header pipe.

Tube 23 is formed as a straight tube which is flattened in the horizontal direction. The end portion of tube 23 is inserted into connection hole 27 of header pipe 22, and fixed therein by, for example, brazing. Corrugate type radiation fins 24 are fixed on the upper and lower surfaces of each tube 23 by, for example, brazing.

Brackets 26 are provided for attaching the heat exchanger to an air conditioner or a body of a vehicle. Each bracket 26 has a U-shaped slot 31 at its end portion. A bolt or the like is inserted through the slot to attach the heat exchanger to the appropriate structure. Brackets 26 are fixed to header pipes 22 by, for example, brazing the curved portions of the brackets on the peripheries of the header pipes.

However, since connection holes 27 in such a conventional heat exchanger are formed on the periphery of header pipe 22 having a circular cross section, a special jig or tool is required for processing the holes. This operation causes the manufacturing of the header pipe to be expensive. Therefore, it is difficult to produce the heat exchanger inexpensively. In addition, defects are liable to occur while inserting and connecting tubes 23 into the header pipes, because it is difficult to form connection holes 27 at precise positions and with desired shapes.

Moreover, since brackets 26 for supporting the heat exchanger is welded (brazed) directly onto the peripheries of header pipes 22, the shape of the brackets must be adapted to the shape of the header pipes. Accordingly, the manufactured brackets are essentially restricted to one shape. Furthermore, because the welding (brazing) of brackets 26 onto the peripheries of header pipes 22 is troublesome, the working efficiency in the bracket attachment process is impaired.

SUMMARY OF THE INVENTION

Accordingly, an object of the present invention is to provide a heat exchanger which can be inexpensively produced by reducing the cost for manufacturing header pipes and wherein defects in the connection of tubes do not occur.

Another object of the present invention is to provide a heat exchanger where, in the assembly of the heat exchanger, the working efficiency of the bracket attachment process can be increased.

To achieve these objectives, a heat exchanger according to the present invention is herein provided. The heat exchanger includes a pair of substantially parallel header pipes and a plurality of substantially parallel tubes disposed between the pair of header pipes. The tubes are connected to the pair of header pipes at their end portions. Each of the header pipes is comprised of a tubular member having an opening which is formed at a position in the circumferential direction of the tubular member and extends in the longitudinal direction of the tubular member. Each header pipe further includes a connecting plate installed in the opening. The connecting plates each define a plurality of holes for receiving the end portions of the tubes to connect the tubes to each of the pair of header pipes.

In a heat exchanger according to an embodiment of the present invention, the tubular member of the header pipes has an attachment portion formed at an outer position of the opening and a bracket fastened to the attachment portion.

In the heat exchanger according to the present invention, the header pipe is formed by installing the connecting plate in the opening of the tubular member. Since the connecting plate is a member separate from the tubular member and the connecting plate can be formed as a simple shape, a special jig or tool is not required for processing the holes in the connecting plate. Therefore, the holes can be easily processed, and the header pipes can be inexpensively manufactured. As a result, the heat exchanger can be inexpensively produced. Further, since the holes can be precisely processed, the tubes are easily inserted into the holes and connected to the header pipes with a desired state.

Moreover, since the attachment portion of the tubular member can be easily formed as a flat portion and the bracket can be fixed to the attachment portion by fastening without welding, the working efficiency in the bracket attachment process can be increased and the production cost of the heat exchanger can be further reduced.

BRIEF DESCRIPTION OF THE DRAWINGS

Some preferred exemplary embodiments of the invention will now be described with reference to the accompanying drawings, which are given by way of example only, and are not intended to limit the present invention.

DETAILED DESCRIPTION OF PREFERRED EMBODIMENTS OF THE INVENTION

Figure 1:
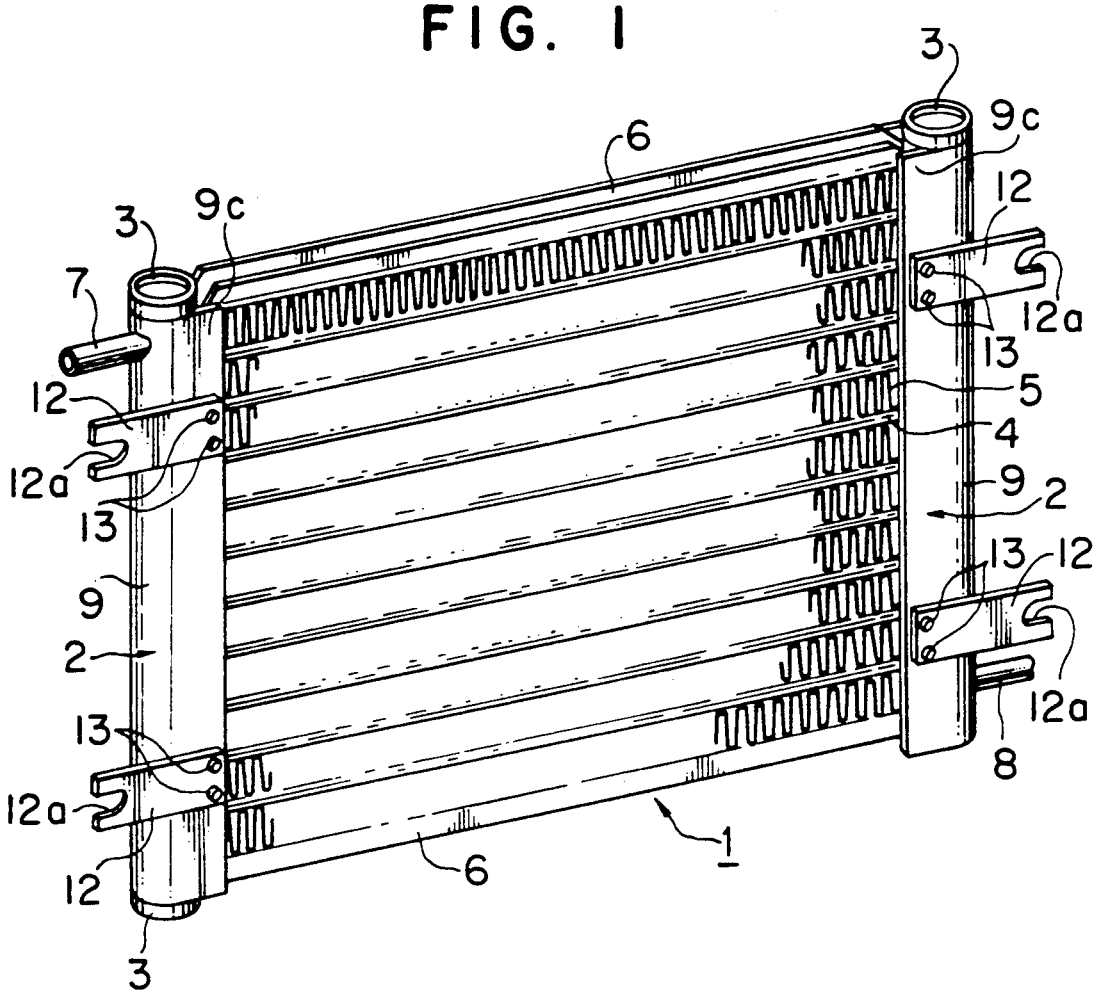
FIG. 1 is a perspective view of a heat exchanger according to a first embodiment of the present invention.
Figure 2:
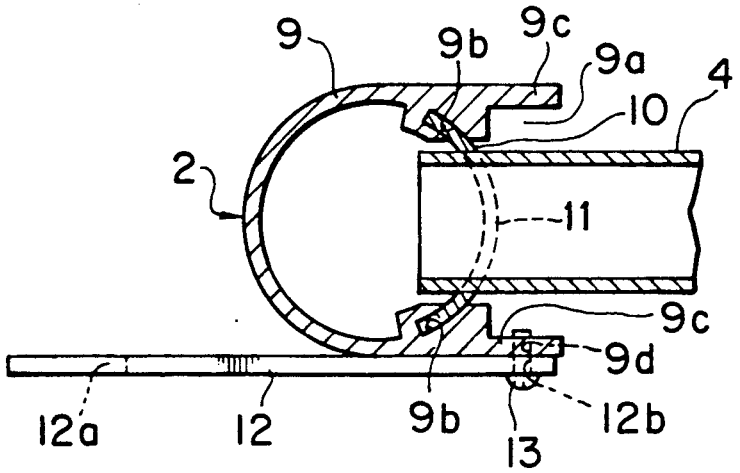
FIG. 2 is an enlarged cross sectional view of the header pipe and the connection portion of the header pipe and the tube of the heat exchanger shown in FIG. 1.
Figure 3:
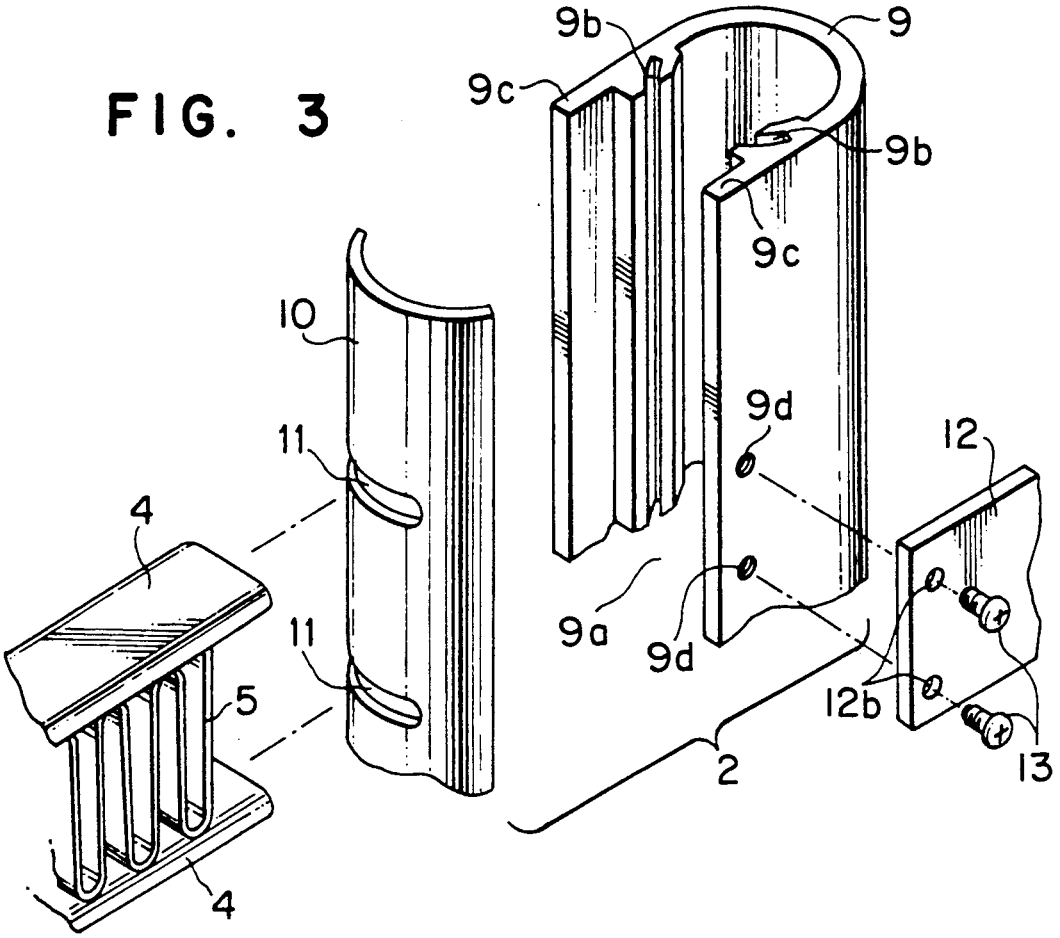
FIG. 3 is a fragmentary exploded perspective view of a part of the header pipe, the connection portion of the header pipe and the tube of the heat exchanger shown in FIG. 1.

Referring to the drawings, FIGS. 1-3 illustrate a heat exchanger according to a first embodiment of the present invention. In FIG. 1, a heat exchanger 1 has a pair of header pipes 2 extending in parallel relation to each other. Header pipes 2 are closed at both of their end portions by caps 3. A plurality of substantially parallel tubes 4 are disposed between the pair of header pipes 2. The tubes 4 are formed as flat tubes in this embodiment. The flat tubes 4 are connected to the pair of header pipes 2 at their end portions. A plurality of corrugate type radiation fins 5 are provided on the sides of flat tubes 4 and fixed to the flat tubes by, for example, brazing. Reinforcement members 6 are provided on the upper surface of the top radiation fin 5 and the lower surface of the bottom radiation fin 5, respectively. The reinforcement members 6 are fixed to the upper and lower surfaces of the respective radiation fins and the sides of header pipes 2. An inlet tube 7 is connected to the upper portion of one of the header pipes 2, and an outlet tube 8 is connected to the lower portion of the other header pipe. A heat medium (for example, a cooling medium or a brine) is introduced through inlet tube 7, flows through header pipes 2 and flat tubes 4, and flows out of outlet tube 8.

Each header pipe 2 is constructed from a tubular member 9 and a connecting plate 10, and which are collectively formed as a cylindrical member. Tubular member 9 has a U-shaped cross section which defines an opening 9*a*. Opening 9*a* is formed at a position in the circumferential direction of the tubular member and extends in the longitudinal direction of the tubular member.

A pair of grooves 9*b* extending in the the longitudinal direction of the tubular member and facing each other are formed on the inner surfaces of the walls defining opening 9*a*.

Plane plate portions 9*c* extend outward from the portions provided with grooves 9*b*, in parallel relation to each other. One of plane plate portions 9*c* functions as an attachment portion for brackets (described later). On this attachment portion, two tapped holes 9*d* are formed on the upper portion and the lower portion of each tubular member 9, respectively. A tubular member 9 having such a structure can be manufactured by, for example, extrusion molding. Although tubular member 9 has a U-shaped cross section in this embodiment, variously shaped tubular members can be used as long as the tubular members have an opening similar to the opening 9*a*.

Connecting plate 10 has a plurality of connection holes 11 with a predetermined pitch arranged in the longitudinal direction of the connecting plate. Connecting plate 10 has a width slightly larger than the distance between the bottoms of both grooves 9*b*, and is press fitted in the grooves along both its edge portions. After the connecting plate 10 is fitted and retained in grooves 9*b*, the connecting plate is fixed to tubular member 9 by brazing. Connecting plate 10 is curved in its cross section to substantially match its curvature with the curvature of the curved portion of tubular member 9. The end portions of tubes 4 are inserted into holes 11 and fixed to connecting plate 10 by brazing. Connecting plate 10 may be installed in grooves 9*b* in opening 9*a* of tubular member 9, after tubes 4 are fixed to the connecting plate. Alternatively, connecting plate 10 may be installed in grooves 9*b* of tubular member 9 prior to the attachment of tubes 4 to the connecting plate.

Brackets 12 are provided for supporting and attaching the heat exchanger to an air conditioner or a body of a vehicle etc.

Bracket 12 is formed as a plane plate in this embodiment. A U-shaped slot 12*a* is formed on one end portion of the bracket, and two through holes 12*b* are formed on the other end portion for attaching the bracket to tubular member 9. Bracket 12 is attached to attachment portion 9*c* of tubular member 9 by bolts 13 (or rivets) which are screwed into tapped holes 9*d* through the through holes 12*b*. In this embodiment, four brackets 12 are attached to header pipes 2 at the upper and lower portions of the respective header pipes.

In the embodiment, header pipe 2 is constructed from tubular member 9 and connecting plate 10. The connecting plate having connection holes 11 is a member separate from the tubular member. Therefore, connecting plate 10 may have a simple shape, and connection holes 11 are easily processed without using a special jig or tool and without troublesome working. Accordingly, header pipes 2 are manufactured easily and inexpensively. Moreover, since connection holes 11 can be easily formed precisely to a desired shape and at desired positions, insertion and connection of tubes 4 can be easily and efficiently accomplished.

Further, because brackets 12 are attached to attachment portion 9*c* of tubular member 9 by fastening, it is not necessary to weld (braze) the brackets directly to the periphery of a header pipe as is required in the assembly of conventional heat exchangers. Therefore, brackets 12 are very easily attached to header pipes 2 without any troublesome working, and various shaped brackets can be employed. This increases the working efficiency in the bracket attachment process and reduces the production cost of the heat exchanger.

Figure 4:
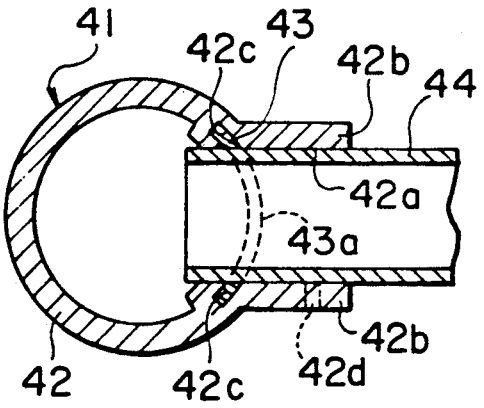
FIG. 4 is a cross sectional view of the connection portion of the header pipe and the tube of a heat exchanger according to a second embodiment of the present invention.

FIG. 4 illustrates a part of a heat exchanger according to a second embodiment of the present invention. In this embodiment, header pipe 41 is constructed from tubular member 42 and connecting plate 43. Connecting plate 43 has a plurality of connection holes 43*a*. The side edges of the connecting plate are inserted into grooves 42*c* formed in tubular member 42. The width of opening 42*a* defined by extended walls 42*b* is substantially the same as the width of tube 44. The sides of tube 44 are engaged by the inner surfaces of the walls 42*b*, and thereby held in place by the walls. The connection portion of tube 44, which is inserted into holes 43*a* and fixed to connecting plate 43, can be reinforced by the walls 42b holding the tube. An attachment portion may be formed on the outer surface of one of the walls 42b. Tapped holes 42d for attaching brackets (not shown) are formed on the attachment portion.

Figure 5:
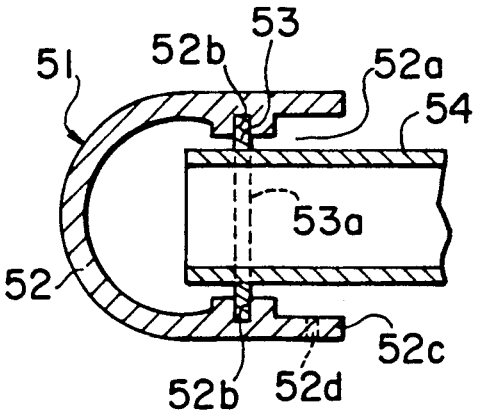
FIG. 5 is a cross sectional view of the connection portion of the header pipe and the tube of a heat exchanger according to a third embodiment of the present invention.
Figure 6:
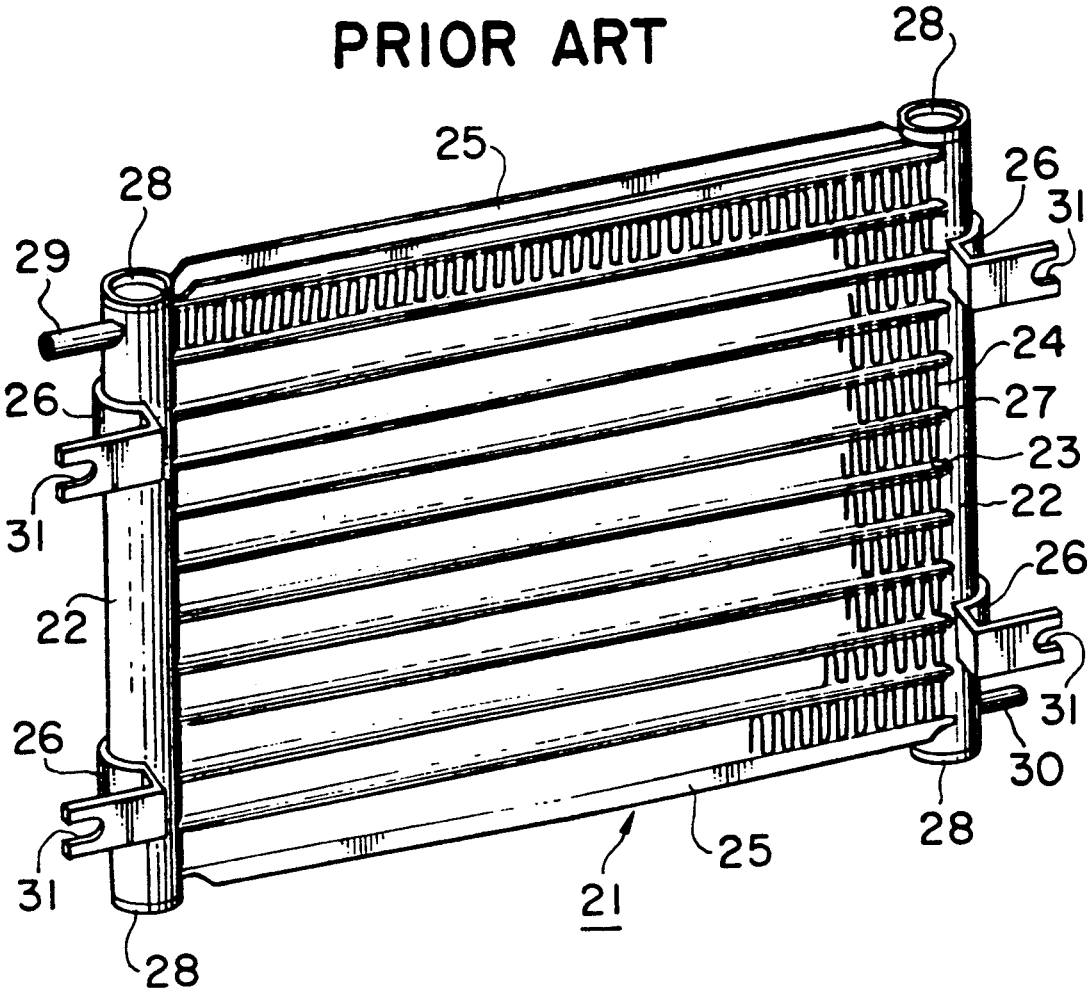
FIG. 6 PRIOR ART
FIG. 6 is a perspective view of a conventional heat exchanger.
Figure 7:
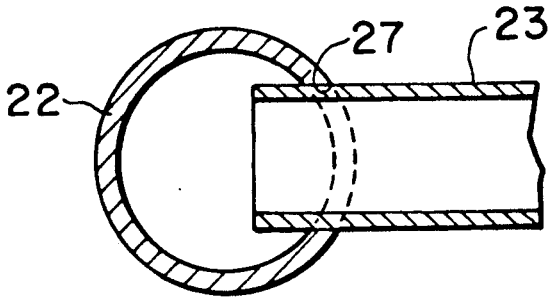
FIG. 7 PRIOR ART
FIG. 7 is an enlarged cross sectional view of the connection portion of the header pipe and the tube of the heat exchanger shown in FIG. 6.

FIG. 5 illustrates a part of a heat exchanger according to a third embodiment of the present invention. In this embodiment, header pipe 51 is constructed from tubular member 52 and connecting plate 53. Tubular member 52 has an opening 52a, inner grooves 52b, attachment portion 52c and tapped holes 52d. Connecting plate 53 has a plurality of connection holes 53a. The side edges of the connecting plate are inserted into grooves 52b formed in tubular member 52. The end portion of tube 54 is inserted into connection hole 53a and fixed to connecting plate 53. Connecting plate 53 is formed as a plane plate. Therefore, connection holes 53a can be processed and positioned even more easily and precisely.

Although several preferred embodiments of the present invention have been described in detail, it will be appreciated by those skilled in the art that various modifications and alterations can be made to these embodiments without materially departing from the novel teachings and advantages of this invention. Accordingly, it is to be understood that all such modifications and alterations are included within the scope of the invention as defined by the following claims.

I claim:

1. In a heat exchanger including a pair of substantially parallel header pipes and a plurality of substantially parallel tubes disposed between said pair of header pipes, each said tube defining a pair of end portions connected to said pair of header pipes, the improvement comprising:

each of said pair of header pipes comprising a tubular member having an opening formed at a position in the circumferential direction of said tubular member and extending in the longitudinal direction of said tubular member, and a connecting plate installed in said opening and having a plurality of holes for inserting said end portions of said tubes therein to connect said tubes to each of said pair of header pipes; and wherein said tubular member has a longitudinal attachment portion formed along an outer position of said opening and a bracket is attached to said attachment portion, said attachment portion allowing attachment of said bracket at positions in between the ends of said tubular member.

2. A heat exchanger according to claim 1 further comprising a plurality of fins provided along sides of said tubes.

3. A heat exchanger according to claim 1 wherein said tubes are flat tubes.

4. A heat exchanger according to claim 1 wherein said tubular member has a pair of grooves in said opening for retaining a pair of side edges of said connecting plate.

5. A heat exchanger according to claim 1 wherein said tubular member has a U-shaped cross section.

6. A heat exchanger according to claim 1 wherein said connecting plate is press fitted in said opening of said tubular member.

7. A heat exchanger according to claim 1 wherein said connecting plate is curved in its cross section to substantially match its curvature with the curvature of the curved portion of said tubular member.

8. A heat exchanger according to claim 1 wherein the width of each of said tubes is substantially the same as the width of said opening of said tubular member.

9. A heat exchanger according to claim 1 wherein said connecting plate is a plane plate.

10. A heat exchanger according to claim 1 wherein said bracket is fixed to said attachment portion by fastening.

11. A heat exchanger according to claim 1 wherein said bracket is formed as a plane plate.

12. A heat exchanger comprising:

a pair of spaced apart header pipes, each said header pipe including a tubular member and a connecting plate, said tubular member defining a longitudinal opening for receiving said connecting plate therein and said connecting plate defining a series of apertures therein:

A plurality of tubes disposed between said header pipes, each said tube being received through said apertures in said connecting plates for interconnecting said tubes and said header pipes and thereby providing a flow path or cooling medium flowing there through:

substantially planar attaching segments projecting outward from said tubular member along opposite sides of said longitudinal opening; and a plurality of brackets attached to said attaching segments for mounting the heat exchanger to a supporting structure, said substantially planar attaching segments allowing attachment of said plurality of brackets at positions in between the ends of said tubular members.

13. A heat exchanger according to claim 12, in which each said tubular member defines a pair of mounting structures which receive opposing edges of one of said connecting plate, and wherein said edges are attached therein to preclude escape of the cooling medium.

14. A heat exchanger according to claim 13, in which said mounting structures are grooves defined along opposite sides of said longitudinal opening in each said tubular member.

* * * * *